US008421694B2

(12) United States Patent
Iso et al.

(10) Patent No.: US 8,421,694 B2
(45) Date of Patent: Apr. 16, 2013

(54) COMPOSITE ANTENNA DEVICE

(75) Inventors: Naoki Iso, Hitachi (JP); Haruyuki Watanabe, Hitachi (JP); Morihiko Ikegaya, Kasumigaura (JP); Tomoyuki Ogawa, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 240 days.

(21) Appl. No.: 12/871,437

(22) Filed: Aug. 30, 2010

(65) Prior Publication Data

US 2011/0187616 A1 Aug. 4, 2011

(30) Foreign Application Priority Data

Feb. 1, 2010 (JP) ..... 2010-019933

(51) Int. Cl.
*H01Q 21/00* (2006.01)

(52) U.S. Cl.
USPC ..... 343/725; 343/770; 343/700 MS; 343/742; 343/826

(58) Field of Classification Search ..... 343/700 MS, 343/702, 767, 866, 795, 792.5, 806
See application file for complete search history.

(56) References Cited

U.S. PATENT DOCUMENTS

| | | | | |
|---|---|---|---|---|
| 6,542,128 | B1 * | 4/2003 | Johnson et al. | 343/742 |
| 7,394,426 | B2 | 7/2008 | Ogawa et al. | |
| 2002/0084943 | A1 * | 7/2002 | Tsai et al. | 343/795 |
| 2004/0056812 | A1 * | 3/2004 | Sabet et al. | 343/725 |
| 2006/0132359 | A1 * | 6/2006 | Chang et al. | 343/700 MS |
| 2009/0213012 | A1 * | 8/2009 | Jiang et al. | 343/700 MS |

FOREIGN PATENT DOCUMENTS

| | | |
|---|---|---|
| JP | 2004-015096 | 1/2004 |
| JP | 2004-187148 | 7/2004 |

* cited by examiner

*Primary Examiner* — Shawki Ismail
*Assistant Examiner* — Christopher Lo
(74) *Attorney, Agent, or Firm* — Antonelli, Terry, Stout & Kraus, LLP.

(57) ABSTRACT

There is provided a composite antenna device for responding to waves in a plurality of radio frequency bands, including: a sheet of conductor plate; a first antenna provided on the sheet of conductor plate for responding to a linearly-polarized wave in at least one radio frequency band; and a second antenna provided on the sheet of conductor plate for responding to a circularly-polarized wave in a radio frequency band that is different from the at least one radio frequency band, wherein the first antenna has a ground portion, the second antenna is formed in an area in the ground portion, and each of the first antenna and the second antenna has a feeding point.

7 Claims, 8 Drawing Sheets

COMPOSITE ANTENNA DEVICE

CLAIM OF PRIORITY

The present application claims priority from Japanese patent application serial no. 2010-019933 filed on Feb. 1, 2010, the content of which is hereby incorporated by reference into this application.

BACKGROUND OF THE INVENTION

1. Field of the Invention

The present invention relates to antennas for wireless communication. The invention particularly relates to a composite antenna device which combines a plurality of antennas into one piece to simultaneously support wireless communications involving different standards.

2. Description of the Related Art

Portable wireless terminals such as a cellular phone, laptop, netbook, sensor network, ultra-mobile personal computer (UMPC), personal navigation device (PND), etc., have been increasingly made smaller, lighter, and thinner with more sophisticated functions, which has increased demands on internal parts to be made smaller. In addition, since wireless communication is crowded with different standards, antennas are often required to support a plurality of frequency bands and different polarized waves.

JP-A 2004-015096 discloses a composite antenna device that responds to a plurality of frequency bands yet is not affected by mutual interference between reception units. The composite antenna device stated in JP-A 2004-015096 has a first antenna unit for communication equipment being responsive to a wave in a first radio frequency band; and a second antenna unit for communication equipment being responsive to a wave in a radio frequency band that is different from the first radio frequency band, in which a trap circuit is provided to the second antenna unit for eliminating interference caused by the wave in the radio frequency band of the first antenna unit.

FIG. 1 is a structural diagram of the trap circuit provided to the second antenna unit in JP-A 2004-015096. As shown in FIG. 1, a trap circuit 102 responsive to the first radio frequency band and a trap circuit 103 responsive to another radio frequency band are provided between an antenna 100 and an LNA (low noise amplifier) input circuit 101.

JP-A 2004-187148 discloses a composite antenna device, in which a plurality of antenna elements having different target frequency bands are more compactly arranged while preventing interference between individual elements. FIG. 2 is a schematic illustration showing a perspective view of a structural appearance of the composite antenna device according to an embodiment of JP-A 2004-187148. In the composite antenna device stated in JP-A 2004-187148, as shown in FIG. 2, an antenna element 210 for GPS (global positioning system), in which an element pattern 212 is printed on a rectangular dielectric plate 211, and an antenna element 220 for ETC (electronic toll collection system), in which an element pattern 222 is printed on a rectangular dielectric plate 221, are arranged in parallel on an antenna substrate 201. In addition, the four sides and the bottom surface of the dielectric plate 221, on which the element pattern 222 for the ETC antenna is formed, is surrounded by a grounding plate 223.

JP-A 2004-015096 states that electric signals in unnecessary radio frequency bands can be shut out by providing the trap circuits 102 and 103 for signals received by the antenna 100, which prevents the device from being affected by mutual interference between the reception units responsive to a plurality of radio frequency bands. However, no concrete explanation is given with regard to the reduction of interference between the first and the second antenna units, which is the underlying cause of the interference, and a challenge still remains which is to reduce interference noise in a target frequency band, generated at a reception stage.

Furthermore, JP-A 2004-187148 states that, by taking at least one of the plurality of antenna elements, 210 and 220, and surrounding the sides and the bottom of the dielectric plate of the selected element pattern with the grounding plate 223, mutual interference between the antenna elements can be reduced in spite of the close arrangement. This technique seems effective in reducing interference when the antenna elements are patch antennas like those described in JP-A 2004-187148; however, when the antenna elements have different structures (for example, slot antennas, etc.), the technique may be difficult to apply or may not be able to reduce interference sufficiently.

SUMMARY OF THE INVENTION

Under these circumstances, it is an objective of the present invention to solve the above problems and to provide a composite antenna device that allows a plurality of antenna elements operating in different radio frequency bands to be combined into one, yet is configured to reduce mutual interference between the antenna elements.

According to one aspect of the present invention, there is provided a composite antenna device for responding to waves in a plurality of radio frequency bands, including: a first antenna for responding to a linearly-polarized wave in at least one radio frequency band; and a second antenna for responding to a circularly-polarized wave in a radio frequency band that which is different from said at least one radio frequency band, both of which antennas are provided on a sheet of conductor plate, wherein the first antenna has a ground portion, the second antenna is formed in an area in the ground portion, and each of the first antenna and the second antenna has a feeding point. In the present invention, the linearly-polarized wave is defined as a vertically-polarized or horizontally-polarized wave.

In the above aspect of the invention, the following modifications and changes can be made.

(i) The area in the ground portion to which the second antenna is formed is an area whose current density is low in the distribution of currents induced by the first antenna in the ground portion.

(ii) The second antenna includes the feeding point and a two-dimensional barcode-like conductor line pattern. The conductor line pattern is obtained by vertically and horizontally dividing a rectangular conductor region into a predetermined number or less of equal segments, and by removing some of the segments to allow the remaining segments to make up the conductor line pattern. In the present invention, the predetermined number is defined as a number appropriately determined based on space available for forming the second antenna in the ground portion or on accuracy and characteristics required for the second antenna.

(iii) The conductor line pattern of the second antenna is configured so that when another conductor plate having a conductor line pattern which is complementary to the above conductor pattern is separately prepared, and an antenna structure that feeds to the complementary conductor line pattern is independently formed, the antenna structure can function as a circularly-polarized antenna responsive to a wave in the same radio frequency band as the second antenna.

(iv) In the antenna structure, the complementary conductor line pattern is determined so that when a current to be induced on the complementary conductor line pattern is projected onto two mutually-perpendicular directions to sum respective projections of complex vectors, a ratio between absolute values of the sums is 0.7 to 1.3 and a phase difference between the sums is 80 to 100 degrees.

(v) The first antenna is a slot antenna.

(vi) The first antenna has two rectangular slots disposed in a row, and each open end of the two rectangular slots is disposed at the opposite end from the other.

(vii) The first antenna has a line-symmetrical shape with respect to a center line of the width of the two rectangular slots as its axis of symmetry.

ADVANTAGES OF THE INVENTION

According to the present invention, it is possible to provide a composite antenna device which allows a plurality of antenna elements operating in different radio frequency bands to be combined into one, yet is configured to reduce mutual interference between the antenna elements.

DETAILED DESCRIPTION OF THE PREFERRED EMBODIMENTS

Figure 1:
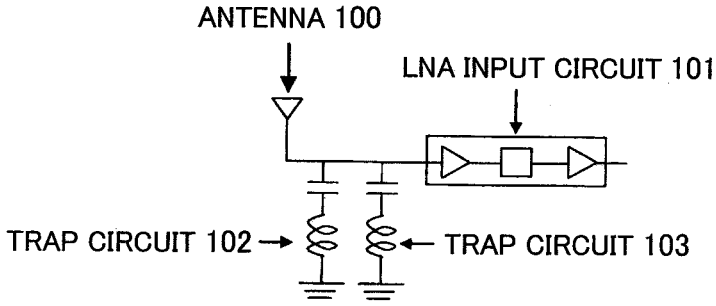
FIG. 1 is a structural diagram of a trap circuit provided to a second antenna unit in JP-A 2004-015096.
Figure 2:
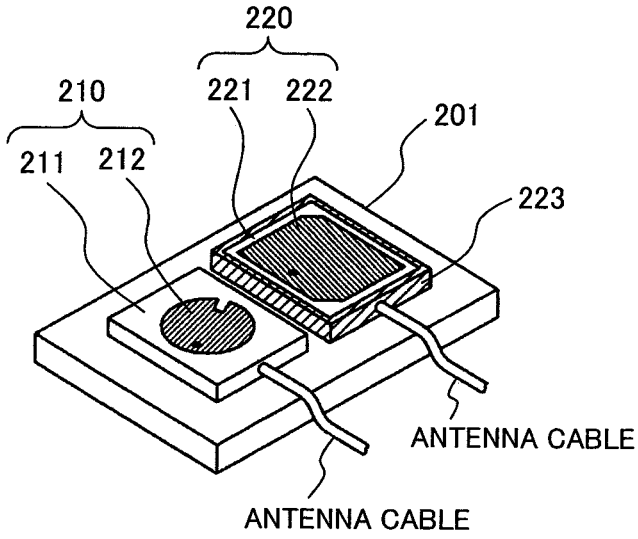
FIG. 2 is a schematic illustration showing a perspective view of a structural appearance of a composite antenna device according to an embodiment of JP-A 2004-187148.

Preferred embodiments of the present invention will be described in detail below with reference to the accompanying drawings. The present invention is not limited to the specific embodiments described below, but various modifications or combinations of its features are possible within the scope of the present invention. Like parts are designated by like reference numerals without repeating the description thereof.

[First Embodiment of the Invention]

Figure 3:
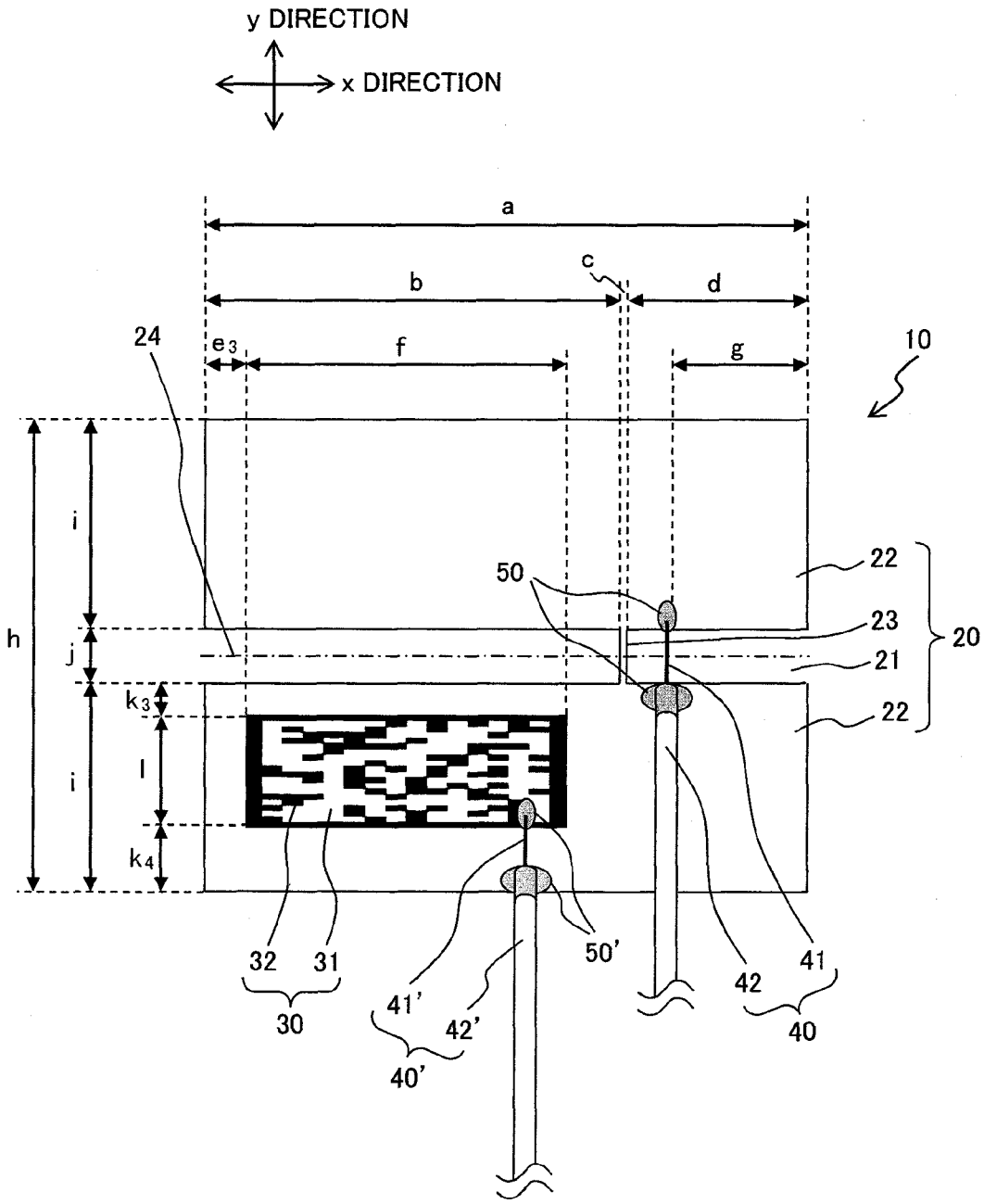
FIG. 3 is a schematic illustration showing a plan view of an example of a composite antenna device according to a first embodiment of the present invention.

FIG. 3 is a schematic illustration showing a plan view of an example of a composite antenna device according to the first embodiment of the present invention. As shown in FIG. 3, a composite antenna device 10 according to the first embodiment has a cellular antenna 20 as a first antenna responsive to waves in two radio frequency bands of 800 MHz and 1900 MHz, and a GPS antenna 30 as a second antenna responsive to a wave in a radio frequency band of 1575 MHz, both of which antennas are provided on a sheet of conductor plate. The cellular antenna 20 is a slot antenna including a rectangular slot 21 and a ground portion 22, and is responsive to a linearly-polarized (vertically-polarized or horizontally-polarized) wave. The GPS antenna 30 is a circularly-polarized antenna formed in an area in the ground portion 22 of the cellular antenna 20. The details of the structures of the cellular antenna 20 and the GPS antenna 30 will be described later. As the conductor plate, a plate or a flexible sheet made of good conductive metal (for example, copper, aluminum, etc.) may be used. A dielectric substrate or an insulation film may be layered on the plate or the flexible sheet.

In the cellular antenna 20 and the GPS antenna 30, coaxial cables 40 and 40' are connected to feeding points 50 and 50', respectively. The cellular antenna 20 is fed in such a way that, at a position of distance "g" away from an open end of the rectangular slot 21, an inner conductor 41 of the coaxial cable 40 is electrically connected to one of the opposing conductor edges across a rectangular slot 21 by a solder material, etc. while an outer conductor 42 of the coaxial cable 40 is electrically connected to the other conductor edge by the same. The GPS antenna 30 is fed in such a way that an inner conductor 41' of the coaxial cable 40' is electrically connected to a radiation element of the GPS antenna 30 by a solder material, etc., and an outer conductor 42' of the coaxial cable 40' is electrically connected to the ground portion 22 of the cellular antenna 20 by the same.

The area where the GPS antenna 30 is formed is preferably an area whose current density is low in the distribution of currents induced by the cellular antenna 20 in the ground portion 22. Since the area with low current density has a minimum contribution to signal radiation, a loss in the radiation characteristics of the cellular antenna 20 caused by providing the GPS antenna 30 can be prevented, as well as interference between the two antennas can be minimized. Furthermore, since the GPS antenna 30 is formed in the ground portion 22 of the cellular antenna 20, the composite antenna device 10 can be downsized at the same time. Moreover, the cellular antenna 20 and the GPS antenna 30 are formed on a single conductor plate, allowing the composite antenna device 10 to be made thinner as well. To be specific, the area of low current density is defined as an area whose current density is 1/40 or less of the maximum current density.

(Detailed Description of Cellular Antenna)

The cellular antenna 20 as the first antenna is explained in detail. As shown in FIG. 3, the cellular antenna 20 has two rectangular slots 21 formed in a row in a conductor plate that has a length "a" in an x direction and a length "h" in a y direction. Each of the two rectangular slots 21 has an open end which is disposed at the opposite end across a slot border conductor 23 having a length "c" in the x direction. The sizes of the two rectangular slots 21 are a length "b" in the x direction by a length "j" in the y direction, and a length "d" in the x direction by a length "j" in the y direction, respectively (a=b+c+d). The length "c" in the x direction of the slot border conductor 23 may be any value as long as it is sufficiently shorter than the lengths "b" and "d" in the x direction of the two rectangular slots 21. The cellular antenna 20 has a line-symmetrical shape with respect to a center line 24 of the width of the two rectangular slots 21 (in the y direction in FIG. 3) as its axis of symmetry.

Now, when a center wavelength of one of the radio frequency bands the cellular antenna 20 supports is λ1 and a center wavelength of the other radio frequency band is λ2, the length "b" in the x direction of one rectangular slot 21 is set to 3/16 times λ1 (b=λ1×3/16) and the length "d" in the x direction of the other rectangular slot 21 is set to 3/16 times λ2 (d=λ2×3/16). The feeding point 50 for supplying power to the cellular antenna 20 is provided to one of the rectangular slots 21 (a distance "g" from the open end of the slot). The above λ1 and λ2 may be appropriately adjusted in consideration of a wavelength shortening effect, which is created according to a positional relationship with various dielectrics or other conductive parts making up the equipment or device to which the composite antenna device 10 of the present invention is installed.

Figure 4:
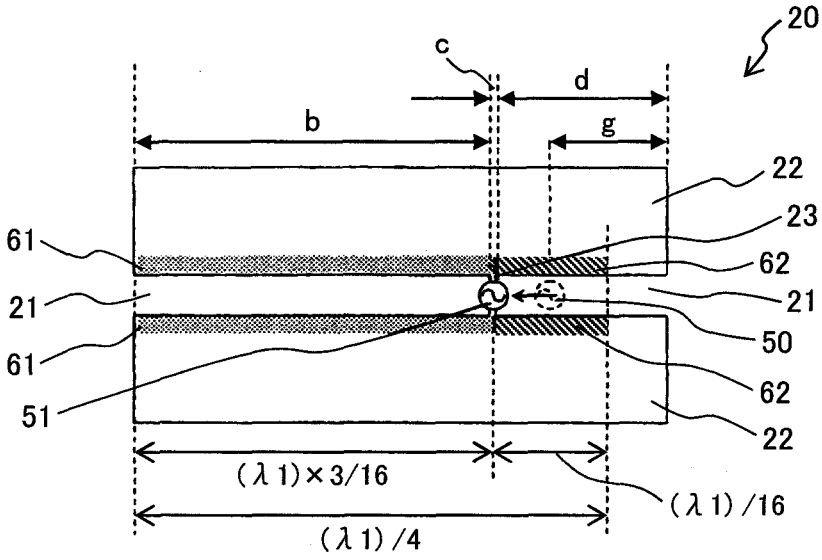
FIG. 4 is a schematic illustration for explaining an operation principle of a first antenna.
Figure 5:
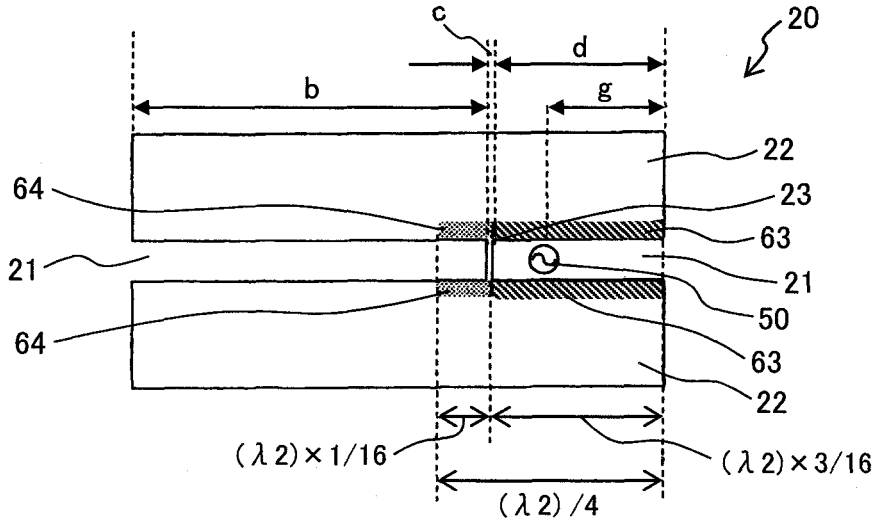
FIG. 5 is another schematic illustration for explaining the operation principle of the first antenna.

FIGS. 4 and 5 are schematic illustrations for explaining the operation principle of the first antenna. When the cellular antenna 20 is used for a wave in the radio frequency band with a center wavelength of λ1, electric currents generated on the conductor plate are distributed, in accordance with resonance, near the opposing conductor edges across the two rectangular slots 21. At this time, the currents are concentrated on the slot border conductor 23, and a virtual feeding point 51 such as the one shown in FIG. 4 is formed on the slot border conductor 23. As a result, with the virtual feeding point 51 as a boundary, current distributions 61 of "λ1×3/16" are generated near the opposing conductor edges of the rectangular slots 21 having the length "b" in the x direction, and current distributions 62 of "λ1×1/16" are generated near the opposing conductor edges of the rectangular slots 21 having the length "d" in the x direction; and as a whole, a slot antenna operating in "λ1×4/16=λ1×1/4" is achieved.

Likewise, when the cellular antenna 20 is used for a wave in the radio frequency band with a center wavelength of λ2, electric currents generated on the conductor plate are distributed, in accordance with resonance, near the opposing conductor edges across the two rectangular slots 21. At this time, since the width "c" of the slot border conductor 23 is sufficiently smaller than the center wavelength λ2, the slot border conductor 23 is not electrically recognized by the wave having a center wavelength λ2. As a result, as shown in FIG. 5, current distributions 63 of "λ2×3/16" are generated near the opposing conductor edges of the rectangular slots 21 having the length "d" in the x direction, current distributions 64 of "λ2×1/16" are generated near the opposing conductor edges of the rectangular slots 21 having the length "b" in the x direction, and as a whole, a slot antenna operating in "λ2×4/16=λ2×1/4" is achieved.

As described above, in the cellular antenna 20 of the composite antenna device 10 according to the present invention, the two rectangular slots 21 are formed in a row in a sheet of conductor plate such that each open end of the two respective rectangular slots 21 across the slot border conductor 23 face opposite directions, thereby achieving the two slot antennas operating in "λ1×1/4" and "λ2×1/4", respectively. In other words, the cellular antenna 20 constitutes the first antenna for responding to a vertically-polarized or horizontally-polarized wave in at least one radio frequency band.

When the radio frequency bands that the cellular antenna 20 supports are, e.g., 800 MHz and 1900 MHz, an example of the size of the cellular antenna 20 will be as follows: a=90 mm, b=62 mm, c=1 mm, d=27 mm, g=20 mm, h=70 mm, i=31 mm, and j=8 mm. The values of g, i, and j may be adjusted to allow the antenna to properly operate in each radio frequency band.

(Detailed Description of GPS Antenna)

Figure 6:
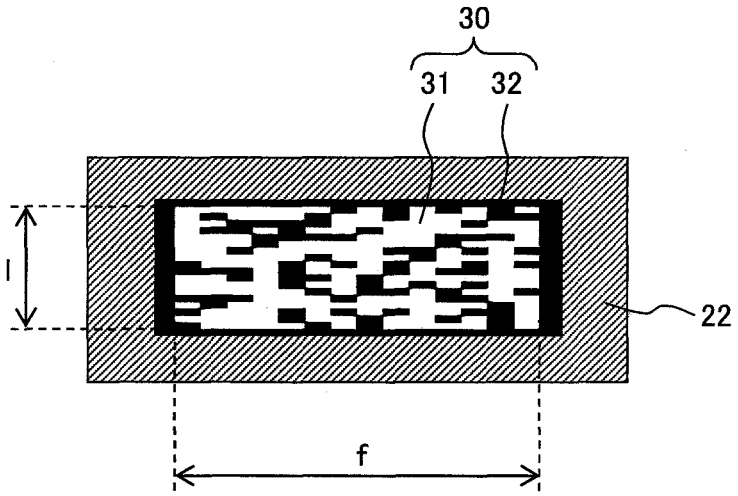
FIG. 6 is a schematic illustration showing an enlarged plan view of a second antenna in FIG. 3.

The GPS antenna 30 as the second antenna is explained in detail. FIG. 6 is a schematic illustration showing an expanded view of the second antenna in FIG. 3. As shown in FIGS. 3 and 6, the GPS antenna 30 includes the feeding point and a two-dimensional barcode-like conductor line pattern, which conductor line pattern is obtained by vertically and horizontally dividing a rectangular conductor region into a predetermined number or less of equal segments, and by removing some of the segments to allow the remaining segments to make up the conductor line pattern. In other words, the two-dimensional barcode-like conductor line pattern is formed by a removed-segment region 31 (a white portion) and a remaining segment 32 (a black portion). As mentioned before, there is no strict limitation for the predetermined number for division; the number may be appropriately determined based on space available for the GPS antenna 30 in the ground portion 22, or accuracy and characteristics required for the GPS antenna 30.

The conductor line pattern of the GPS antenna 30 is configured so that when another conductor plate having a conductor line pattern complementary to the above conductor pattern is separately prepared, and an antenna structure that feeds to the complementary conductor line pattern is independently formed, the antenna structure can function as a circularly-polarized antenna responsive to a wave in the same radio frequency band as the second antenna. The antenna structure having the complementary conductor line pattern is preferably configured as a circularly-polarized antenna proposed in U.S. Pat. No. 7,394,426 (whose content is also incorporated by reference into this application).

Figure 7:
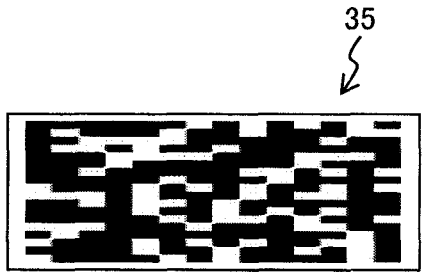
FIG. 7 is a schematic illustration showing a plan view of an antenna structure having a conductor line pattern in a complementary relationship with the second antenna in FIG. 6.

FIG. 7 is a schematic illustration showing a plan view of the antenna structure having the conductor line pattern in a complementary relationship with the second antenna shown in FIG. 6. The "complementary relationship" is, as can be seen by comparing FIGS. 6 and 7, a relationship in which a region of radiation elements (a conductor line pattern) and a region without radiation elements (a conductor line pattern) are reversed. As mentioned above, the antenna structure 35 in FIG. 7 is based on the structure proposed in U.S. Pat. No. 7,394,426, and able to radiate a circularly-polarized wave independently.

The reason to make the GPS antenna 30 in the complementary relationship with the antenna structure 35 is explained. The antenna structure 35 is to function as a circularly-polarized antenna while having no conductor in the outer edge region of the conductor line pattern (see FIG. 7). If this antenna structure 35 is formed in an area in the ground portion 22 of the cellular antenna 20 as is, the radiation elements (a conductor line pattern) in the outermost circumference of the antenna structure 35 connect with the ground portion 22, substantially enlarging the shape of the radiation elements in the outermost circumference. This hinders the antenna structure 35 to maintain its fundamental radiation characteristics.

On the other hand, the GPS antenna 30 that is complementary to the antenna structure 35 is to function as a circularly-polarized antenna while having a conductor in the outer edge region of the conductor line pattern (see FIG. 6). Therefore, the GPS antenna 30 can maintain its fundamental radiation characteristics even when it is formed in an area in the ground portion 22 of the cellular antenna 20. In other words, the GPS antenna 30 that is in the complementary relationship with the antenna structure 35 is preferably used as the second antenna of the composite antenna device 10 in the present invention.

The conductor line pattern of the antenna structure 35, which is in the complementary relationship with the GPS antenna 30, is set so that when a current to be induced on the complementary conductor line pattern is projected onto two mutually-perpendicular directions to sum respective projections of complex vectors, a ratio between absolute values of the sums is 0.7 to 1.3 and a phase difference between the sums is 80 to 100 degrees (see U.S. Pat. No. 7,394,426 for the design concept in detail).

As a circularly-polarized antenna other than the GPS antenna 30, there is one which uses two antennas each radiating a linearly-polarized wave, for radiating a circularly-polarized wave by equalizing resonant frequencies of the two waves and varying the phases by ¼ wavelength. In contrast, in the present invention, the GPS antenna 30 can independently function as a circularly-polarized antenna and its resonant frequency is different from that of the cellular antenna 20. Such structure is effective in reducing mutual interference between the cellular antenna 20 and the GPS antenna 30.

The area for disposing the GPS antenna 30 is explained next. The GPS antenna 30 is preferably formed in an area whose current density is low in the distribution of currents induced by the cellular antenna 20 in the ground portion 22 (an area whose current density is 1/40 or less of the maximum current density). Since the area with low current density has a minimum contribution to signal radiation, an effect on the radiation characteristics of the cellular antenna 20 caused by providing the GPS antenna 30 can be minimized, as well as mutual interference between the cellular antenna 20 and the GPS antenna 30 can be reduced.

The distribution of currents induced by the cellular antenna 20 in the ground portion 22 can be analyzed using, e.g., analysis software by Sonnet Software, Inc. Using the previously-mentioned values for the size of the cellular antenna 20, the analysis was carried out under the feed conditions of a 50-Ω load impedance and a 1-V amplitude.

Figure 8:
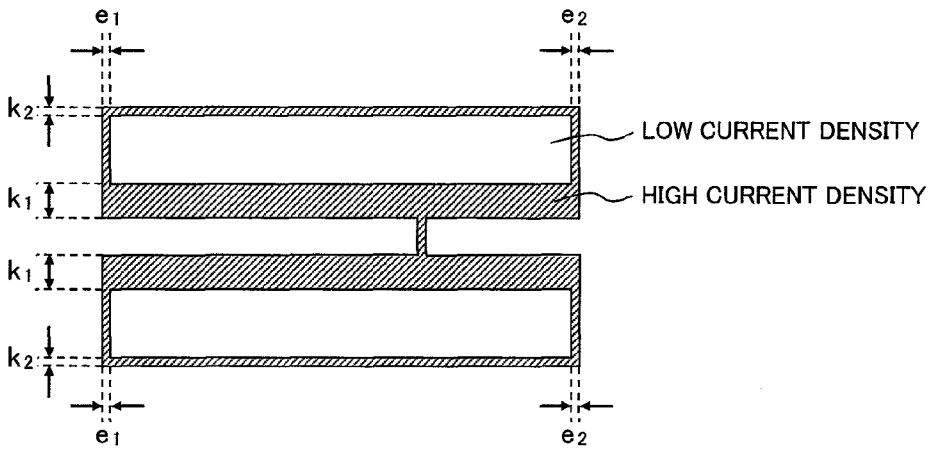
FIG. 8 is an example of analysis results of the distribution of currents induced by the first antenna in a ground portion.

FIG. 8 is an example of the analysis results of the distribution of currents induced by the first antenna in the ground portion. In FIG. 8, a white area is an area whose current density is 1/40 or less of the maximum current density in the current distribution, and a hatched area is an area whose current density is more than 1/40 of the maximum current density. The analysis has shown the size of the area whose current density was more than 1/40 of the maximum current density, as follows: $k_1$=5 mm, $k_2$=1 mm, $e_1$=1 mm, and $e_2$=1 mm.

From the above result of the analysis, the maximum permissible size of the GPS antenna 30 is said to be where a length "l (el)" in the y direction is "i-$k_1$-$k_2$" and a length "f" in the x direction is "a-$e_1$-$e_2$"; where the length "l (el)" in the y direction and the length "f" in the x direction may be set to generate a good circularly-polarized wave based on the previously-described design concept of the antenna structure 35. An example of the size of the GPS antenna 30 is as follows: l (el)=16 mm and f=48 mm.

The GPS antenna 30 may be placed basically anywhere in the area whose current density is 1/40 or less of the maximum current density in the current distribution in the ground portion 22 (the white area in FIG. 8). It is vital, however, that the GPS antenna 30 is placed so as not to cause a feeding line for the cellular antenna 20 (e.g., the coaxial cable 40) to cross over the GPS antenna 30, not to cause a feeding line for the GPS antenna 30 (e.g., the coaxial cable 40') to cross over the rectangular slot 21, and not to cause the feeding lines (e.g., the coaxial cables 40 and 40') to cross over each other. This is because all of these may cause the antenna to lose some of the radiation characteristics. An example of the arrangement of the GPS antenna 30 is as follows: $k_3$=5 mm, $k_4$=10 mm, and $e_3$=6 mm.

(Evaluation of Radiation Characteristics of Composite Antenna Device)

The radiation characteristics of the composite antenna device 10 according to the first embodiment of the present invention were measured and evaluated. The size of the composite antenna device 10 used for the measurement and evaluation was, as described above, as follows: a=90 mm, b=62 mm, c=1 mm, d=27 mm, $e_1$=1 mm, $e_2$=1 mm, $e_3$=6 mm, f=48 mm, g=20 mm, h=70 mm, i=31 mm, j=8 mm, $k_3$=5 mm, $k_4$=10 mm, and l (el)=16 mm. A dielectric substrate on which surface a 0.03 mm-thick copper foil was formed, was used as a conductor plate. As a feeding line, a coaxial cable (1.1 mm in diameter) of which, ferrite was fixed to the portion not overlapping a conductor portion, was used. For comparative reference, an independent (not composite) cellular antenna and an antenna structure 35 (complementary to the GPS antenna 30) for GPS were separately prepared in the same size as above.

Figure 9:
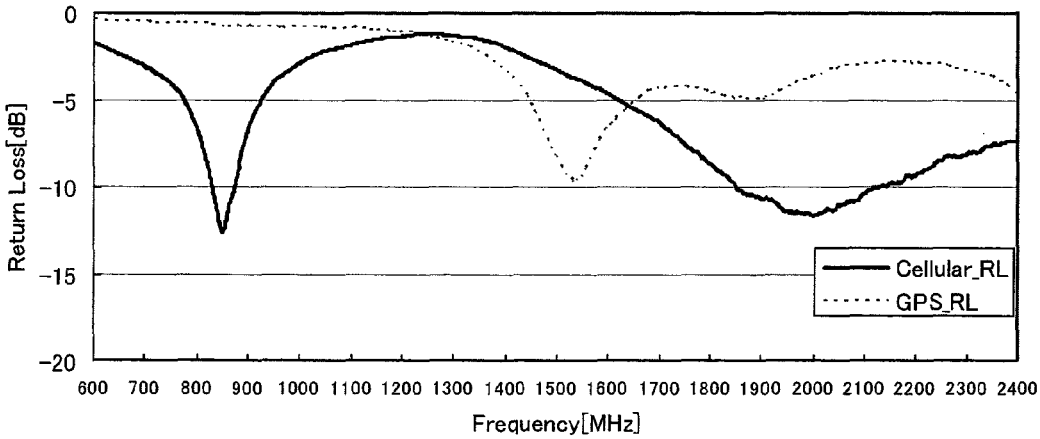
FIG. 9 is an example of measurement results of frequency resonance characteristics of the first antenna (a cellular antenna) and the second antenna (a GPS antenna) in the composite antenna device according to the first embodiment.

FIG. 9 is an example of the results of measuring the frequency resonance characteristics of the first antenna (the cellular antenna) and the second antenna (the GPS antenna) in the composite antenna device according to the first embodiment. The horizontal axis of the graph shows frequency and the vertical axis shows return loss, respectively. As shown in FIG. 9, the cellular antenna 20 operates in two radio frequency bands (800 MHz and 1900 MHz), and the GPS antenna 30 operates in a radio frequency band of 1575 MHz. The above return loss characteristics were the same as the return loss characteristics of the cellular antenna and the antenna structure 35 for comparative reference. That is, the results have shown that combining both antennas into one caused no problems.

Figure 10A:
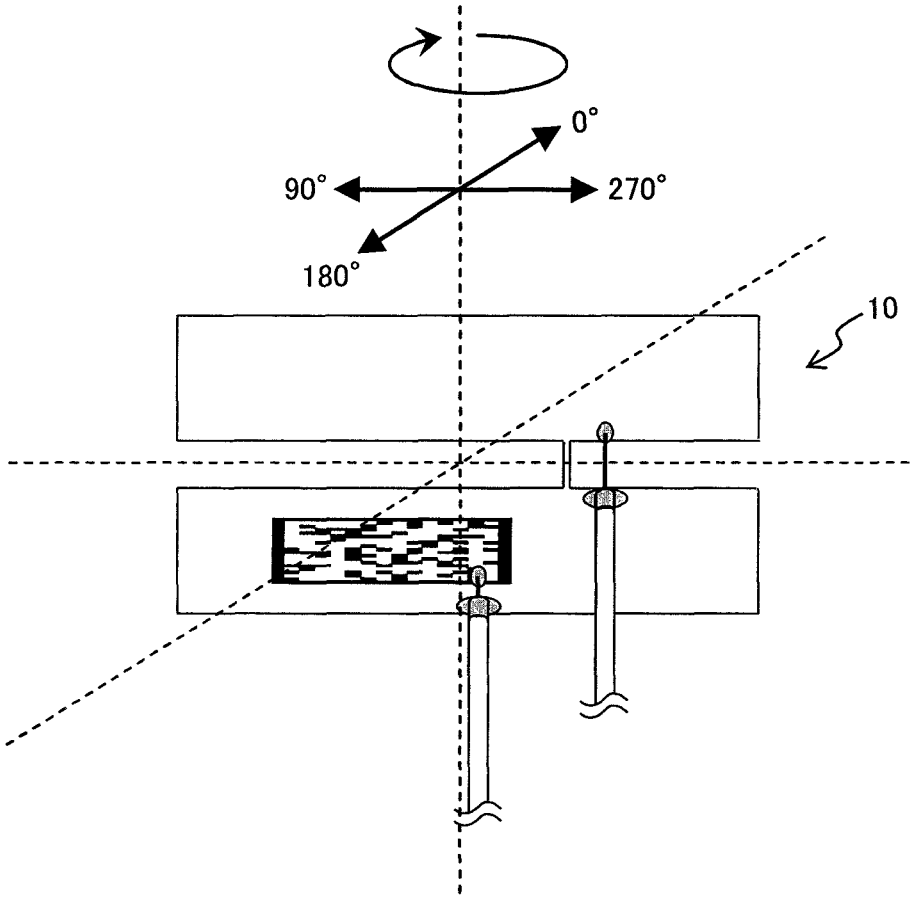
FIG. 10A is a schematic illustration showing how planes are defined for measuring power radiation distribution characteristics in a far field of the composite antenna device according to the first embodiment.
Figure 10B:
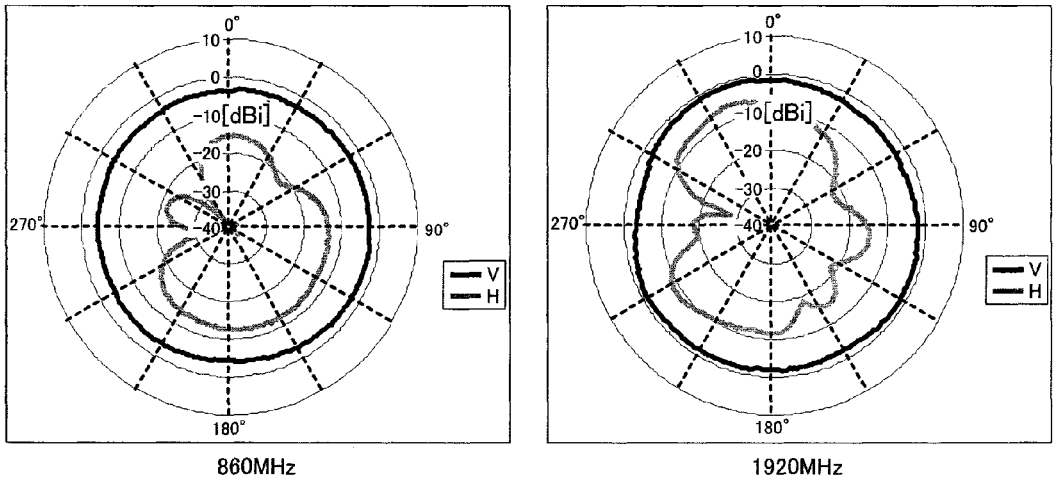
FIG. 10B is an example of measurement results in two resonant frequency bands of the first antenna (the cellular antenna).
Figure 10C:
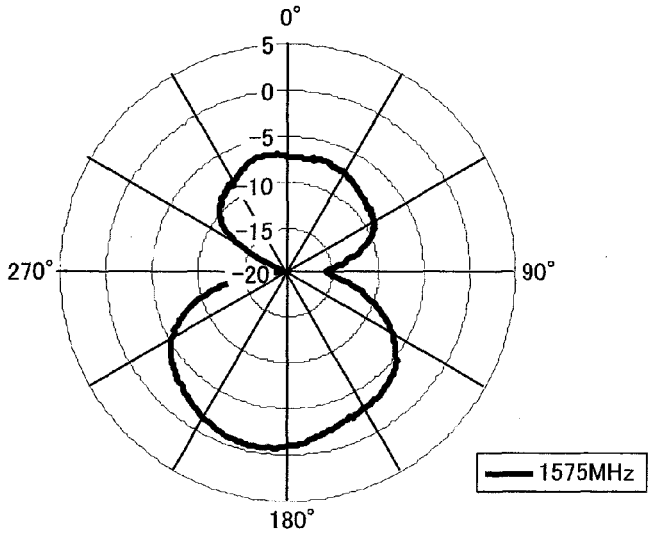
FIG. 10C is an example of measurement results (right-handed circularly polarized wave gain) in a resonant frequency band of the second antenna (the GPS antenna).

FIG. 10A is a schematic illustration showing how planes are defined for measuring power radiation distribution characteristics in a far field of the composite antenna device according to the first embodiment. FIG. 10B is an example of the measurement results in two resonant frequency bands of the first antenna (the cellular antenna). In FIG. 10B, a vertically-polarized wave (V) and a horizontally-polarized wave (H) are separately shown. FIG. 10C is an example of the measurement results (right-handed circularly polarized wave gain) in a resonant frequency band of the second antenna (the GPS antenna).

As can be seen in FIG. 10B, the results have shown that a good directional characteristic (nondirectional) was obtained for a vertically-polarized wave in each of the two radio frequency bands. As can be seen in FIG. 10C also, the result has shown that a good directional characteristic was obtained for a right-handed circularly polarized wave from the antenna plane to the vertical direction (180 degrees).

From the results shown in FIGS. 9, 10B, and 10C, the composite antenna device 10 according to the first embodiment of the present invention is verified to be a composite antenna device that allows an antenna element (the cellular antenna 20) for effectively transmitting and receiving a vertically-polarized wave, and an antenna element (the GPS antenna 30) formed in an area in the ground portion 22 of the cellular antenna, for effectively receiving a circularly-polarized wave, to be combined into one, yet is configured to reduce mutual interference between the antenna elements.

[Second Embodiment of the Invention]

Figure 11:
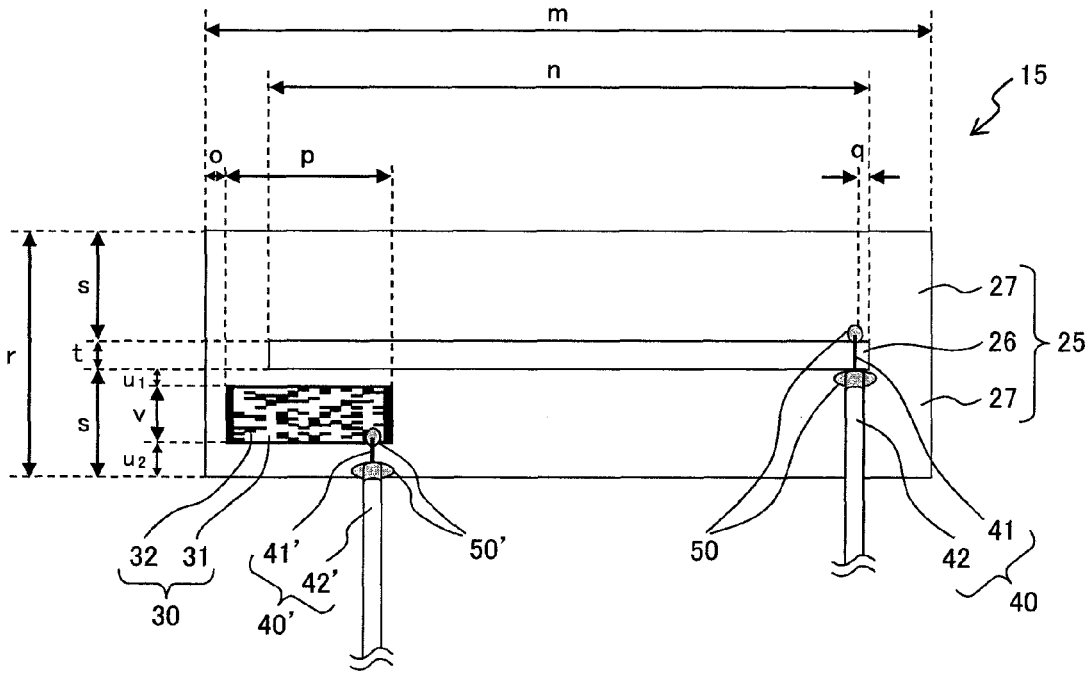
FIG. 11 is a schematic illustration showing a plan view of an example of a composite antenna device according to a second embodiment of the present invention.

FIG. 11 is a schematic illustration showing a plan view of an example of a composite antenna device according to the second embodiment of the present invention. As shown in FIG. 11, a composite antenna device 15 according to the second embodiment is different in a way that its first antenna includes a cellular antenna 25 having only one rectangular slot 26 and a ground portion 27, instead of the cellular antenna 20 of the composite antenna device 10 according to the first embodiment.

The cellular antenna 25 is, for example, a slot antenna operating in a radio frequency band of 800 MHz. A GPS antenna 30 is designed and disposed based on the same concept and method as in the first embodiment. A feeding method for the cellular antenna 25 (the first antenna) and the GPS antenna 30 (the second antenna) is identical to the composite antenna device 10 according to the first embodiment.

An example of the size of the composite antenna device 15 according to the second embodiment of the present invention is as follows: m=210 mm, n=174 mm, o=6 mm, p=48 mm, q=3 mm, r=70 mm, s=31 mm, t=8 mm, $u_1$=5 mm, $u_2$=10 mm, and v=16 mm. A dielectric substrate on which surface a 0.03 mm-thick copper foil is formed is used as a conductor plate.

In the same manner as in the first embodiment, radiation characteristics of the composite antenna device 15 according to the above second embodiment were measured and evaluated, and the same radiation characteristics as in the first embodiment were obtained. That is, the composite antenna device 15 according to the second embodiment is also verified to be a composite antenna device that allows an antenna element (the cellular antenna 25) for effectively transmitting and receiving a vertically-polarized wave, and an antenna element (the GPS antenna 30) formed in an area in a ground portion 27 of the cellular antenna, for effectively receiving a circularly-polarized wave, to be combined into one, yet is configured to reduce mutual interference between the antenna elements.

[Other Embodiments of the Invention]

In addition to the first and second embodiments described above, existing antenna structures such as a reverse-F antenna or a monopole antenna made up by combining a radiation element and a ground portion may be employed as the first antenna for responding to a vertically-polarized or horizontally-polarized wave. In this case also, after checking the current distribution in the ground portion of the first antenna, the second antenna responsive to a circularly-polarized wave can be installed in an area having a small current distribution (an area whose current density is 1/40 or less of the maximum current density) in order to obtain the same radiation characteristics as in the first and second embodiments.

Although the present invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A composite antenna device for responding to waves in a plurality of radio frequency bands, comprising:

a sheet of conductor plate;

a first antenna provided on the sheet of conductor plate for responding to a linearly-polarized wave in at least one radio frequency band; and a second antenna provided on the sheet of conductor plate for responding to a circularly-polarized wave in a radio frequency band that is different from the at least one radio frequency band, wherein:

the first antenna comprises a ground portion, the second antenna is formed in an area in the ground portion, each of the first antenna and the second antenna comprises a feeding point, and the second antenna comprises the feeding point and a two-dimensional barcode-like conductor line pattern, the conductor line pattern being obtained by vertically and horizontally dividing a rectangular conductor region into a predetermined number or less of equal segments, and by removing some of the segments to allow the remaining segments to make up the conductor line pattern.

2. The composite antenna device according to claim 1, wherein:

the area in the ground portion for forming the second antenna is an area whose current density is low in the distribution of currents induced by the first antenna in the ground portion.

3. The composite antenna device according to claim 1, wherein:

the conductor line pattern of the second antenna is configured so that when another conductor plate having a conductor line pattern complementary to the above conductor pattern is separately prepared, and an antenna structure that feeds to the complementary conductor line pattern is independently formed, the antenna structure functions as a circularly-polarized antenna responsive to a wave in the same radio frequency band as the second antenna.

4. The composite antenna device according to claim 3, wherein:

in the antenna structure, the complementary conductor line pattern is determined so that when a current to be induced on the complementary conductor line pattern is projected onto two mutually-perpendicular directions to sum respective projections of complex vectors, a ratio between absolute values of the sums is 0.7 to 1.3 and a phase difference between the sums is 80 to 100 degrees.

5. The composite antenna device according to claim 1, wherein the first antenna is a slot antenna.

6. The composite antenna device according to claim 5, wherein:

the first antenna comprises two rectangular slots disposed in a row, and each open end of the two rectangular slots is disposed at the opposite end from the other.

7. The composite antenna device according to claim 6, wherein the first antenna has a line-symmetrical shape with respect to a center line of the width of the two rectangular slots as its axis of symmetry.

* * * * *